US005370752A

United States Patent [19]

Sakai

[11] Patent Number: 5,370,752

[45] Date of Patent: Dec. 6, 1994

[54] CAST STEEL SUITABLE FOR MACHINING

[75] Inventor: Jun Sakai, Saitama, Japan

[73] Assignee: Honda Giken Kogyo Kabushiki Kaisha, Tokyo, Japan

[21] Appl. No.: 70,663

[22] Filed: Jun. 2, 1993

[30] Foreign Application Priority Data

Jun. 9, 1992 [JP] Japan ..... 4-176129

[51] Int. Cl.[5] ..... C22C 37/04; C22C 38/02

[52] U.S. Cl. ..... 148/331; 420/83

[58] Field of Search ..... 148/331; 420/83; C22C 37/04, 38/02

[56] References Cited

FOREIGN PATENT DOCUMENTS 54-131522 10/1979 Japan .

55-138056 10/1980 Japan ..... 420/83

63-103049 5/1988 Japan .

*Primary Examiner*—Richard O. Dean

*Assistant Examiner*—Sean Vincent

*Attorney, Agent, or Firm*—Armstrong, Westerman, Hattori , McLeland & Naughton

[57] ABSTRACT

To provide graphitic cast steel given with improved machining and mechanical properties, a large number of fine graphite nodules can be crystallized in the cast steel, and the occurrence of chain-like formation of graphite crystals can be avoided by limiting the Bi content in the cast steel to the range between 0.005% and 0.0150%. The composition essentially consists of 0.45 to 1.5 wt % carbon (C), 1.0 to 5.5 wt % silicon (Si), 0.008 to 0.25 wt % rare earth elements (REM), optionally, 0.002 to 0.020 wt % calcium (Ca, 0.005 to 0.0150 wt % bismuth (Bi), 0.005 to 0.080 wt % aluminum (Al), and balance iron (Fe) and inevitable impurities. The cast steel can achieve favorable machining and mechanical property even in its as cast condition.

7 Claims, 12 Drawing Sheets x 100 x 100

Fig. 9(a)
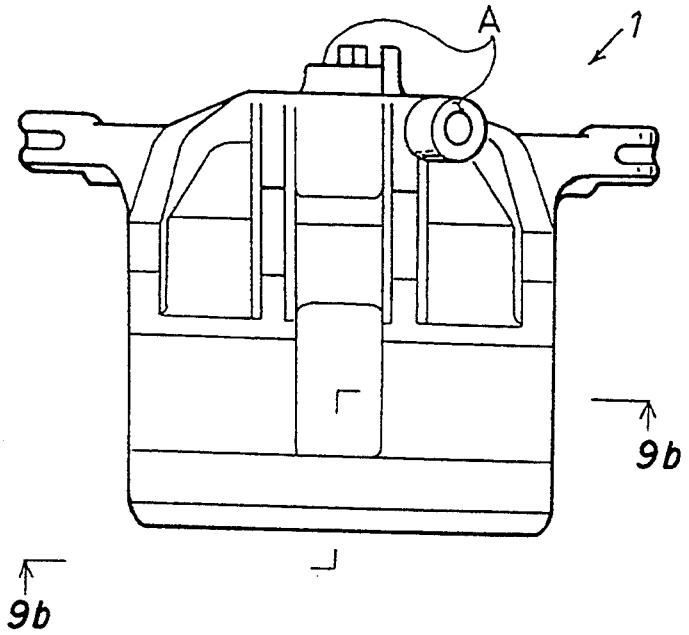
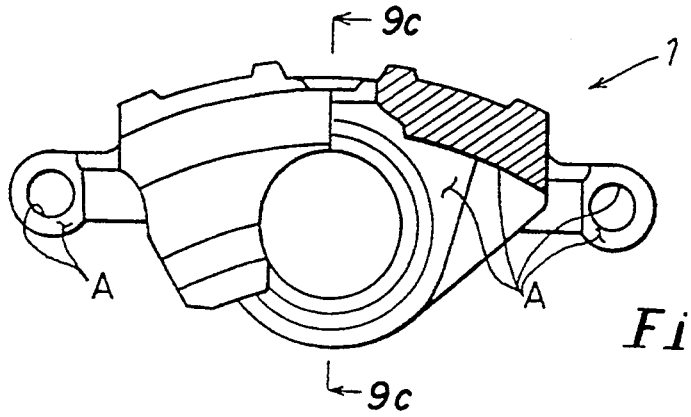
Fig. 9(b)
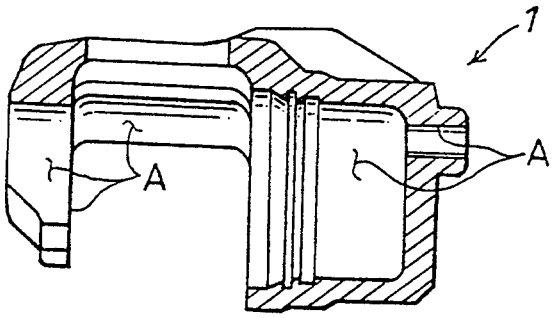
Fig. 9(c)

CAST STEEL SUITABLE FOR MACHINING

TECHNICAL FIELD

The present invention relates to graphitic cast steel having favorable machining and mechanical properties, and in particular to graphitic cast steel which is suitable for fabricating components which are complex in shape, and require favorable casting and machining properties and high rigidity such as brake calipers for automotive disk brakes.

BACKGROUND OF THE INVENTION

Conventionally is known graphitic cast steel which contains precipitated graphite nodules therein for improving the properties of the cast steel for plastic working and machining. As well known in the art, it is preferable to have fine graphite nodules distributed in the cast steel as densely and uniformly as possible in view of improving frictional and machining properties characterized by short machining chips.

As a method for precipitating graphite in cast steel, it is conceivable to use a heat treatment process, but a desired result may not be obtained because the heat treatment will require a considerable time period and the precipitated graphite may be too coarse to be acceptable and may not be as nodular as desired.

For instance, in Japanese patent laid-open publication (kokai) No. 63-103049, it is disclosed to add rare earth elements for the purpose of distributing fine graphite nodules in the cast steel at high density and uniformity. This non-examined patent publication teaches that machining property can be improved by adding 0.4 wt % or less of bismuth as an element for improving machining property (0.02 wt %, 0.05 wt % and 0.13 wt % in the disclosed embodiments), and that as the bismuth content increases beyond 0.4 wt % the graphite will lose the nodular shape and both machining and mechanical properties will be impaired.

However, the Inventor has discovered that, even in the above mentioned technology, fine graphite particles are favorably dispersed only when the cooling rate at the time of casting is sufficiently high, and chain-shaped graphite formation tends to develop in the manner of networks when the cooling rate is low due to the large size of the product or the nature of the process of casting, depending on the content of bismuth. Even within the same product, the parts involving low cooling rate such as thick wall portions and the sprues tend to be subjected to such problems. Such chain-like formation of graphite crystals impairs such properties as mechanical strength, elongation and rigidity, or results in substantially undesirable mechanical properties in the cast steel as opposed to favorably distributed graphite nodules.

BRIEF SUMMARY OF THE INVENTION

In view of such problems of the prior art, and the above mentioned recognition by the inventor, a primary object of the present invention is to provide graphitic cast steel which offers a favorable machining property, and is economical to fabricate.

A second object of the present invention is to provide graphitic cast steel having favorable machining and coldworking properties.

A third object of the present invention is to provide graphitic cast steel having a favorable machining property and a high mechanical strength.

According to the present invention, these and other objects can be achieved by providing graphitic cast steel, essentially consisting of 0.45 to 1.5 wt % carbon (C), 1.0 to 5.5 wt % silicon (Si), 0.008 to 0.25 wt % rare earth elements (REM), optionally, 0.002 to 0.020 wt % calcium (Ca), 0.0005 to 0.0150 wt % bismuth (Bi), 0.005 to 0.080 wt % aluminum (Al), and balance iron (Fe) and inevitable impurities.

Preferably, the inevitable impurities include no more than 1.0 wt % manganese (Mn), no more than 0.05 wt % sulphur (S), and no more than 0.15 wt % phosphorus (P).

Now the basis for restricting the content of each element according to the present invention is explained in the following.

C: 0.45% to 1.5%

Carbon is the essential element for the formation of graphite. When the carbon content is below the lower limit of 0.45% by weight (in the claims and the description of this application "% by weight" is indicated as "wt %" or simply as "%"), carbon fails to crystallize as nodular graphite, and improvement in machining and casting properties cannot be achieved. On the other hand, when the carbon content exceeds the upper limit of 1.5%, the nodularization ratio will drop below 70%, impairing mechanical strength and elongation. Further, coarsening and segregation of graphite crystal grains tend to occur, thereby increasing the distances between adjacent graphite crystals and impairing the machining property of the cast product.

Si: 1.0% to 5.5%

Si promotes the crystallization of graphite, but produces no appreciable effect if its content is less than the lower limit of 1.0%, leading to the failure to crystallize into nodular graphite and achieve any improvement in machining and casting properties. On the other hand, when the Si content exceeds the upper limit of 5.5%, the nodularization of graphite will be less than 70%, and the resulting increase in silico-ferrite will increase the hardness of the cast steel, thereby significantly impairing mechanical strength, ductility, and toughness.

REM: 0.008% to 0.25%

REM promotes the precipitation of graphite, and substantially no graphite precipitates when there is no REM content. When the REM content is less than the lower limit of 0.008%, there is no crystallization of graphite, and favorable machining and casting properties cannot be attained. When the REM content is increased beyond the upper limit of 0.25%, there will be only partial crystallization of graphite, and machining and casting properties are impaired. Further, chain-like formation of graphite occurs, and this impairs mechanical strength and elongation.

Ca: 0.002% to 0.020%

When Ca is added to the cast steel in combination with REM, a Ca-based free-machining substance is produced, and this substance not only improves machining property but also assists REM in promoting the precipitation of graphite and improves the fineness of the graphite nodules. However, when the Ca content is less than the lower limit of 0.002%, there will be no appreciable effect. When Ca is added beyond the upper limit of 0.020%, coarsening and segregation of graphite crystal grains tend to occur, thereby increasing the distances between adjacent graphite crystals and impairing the machining property of the cast product.

Bi: 0.0005% to 0.0150%

Bi is an element which can contribute to the improvement in the machining property of the cast steel. By adding Bi by an appropriate amount, formation of chain-like graphite crystals can be avoided. In particular, when the C content is equal to or greater than 1.2% or when Si content is equal to or greater than 2.5%, or, in other words, in a condition which is normally prone to the formation of chain-like graphite crystals, formation of chain-like graphite crystals can be effectively prevented by adding an appropriate amount of Bi. When the Bi content is less than 0.0005%, formation of chain-like graphite crystals will occur, thereby substantially impairing mechanical strength and toughness. When the Bi content exceeds the upper limit of 0.0150%, its effectiveness in finely distributing graphite nuclei is reduced, and formation of chain-like graphite crystals may occur. With Bi acting as an element which prevents nodularization of graphite, failure to nodularize graphite crystals will impair mechanical strength and elongation, and failure to crystallize graphite impairs casting and machining properties.

Al: 0.005% to 0.080%

When the Al content is less than 0.005% the deoxidization may become insufficient, and due to the deactivation of REM by oxidization graphite will fail to crystallize. Further, gas voids which may be produced in the cast steel may lower the quality of the cast steel to an unacceptable level. On the other hand, when the Al content exceeds 0.080%, it acts as an element which obstructs the nodularization of graphite, and it impairs mechanical strength and elongation.

The inevitable impurities include Mn, S and P, and their contents should be below 1.0%, 0.05% and 0.15%, respectively. If the Mn content exceeds 1.0%, the crystallization of graphite is obstructed, and the matrix tends to become brittle. When the S content exceeds 0.05%, it will react with REM, and obstruct the nodularization of graphite. When the P content exceeds 0.15%, $Fe_3P$ is produced, and the resulting reduction in elongation will increase the brittleness of the cast steel.

BRIEF DESCRIPTION OF THE DRAWINGS

Now the present invention is described in the following with reference to the appended drawings, in which:

FIG. 9(*a*) is a plan view of a caliper body for a disk brake unit to which the cast steel of the present invention is applied, FIG. 9(*b*) is a sectional view taken along line a—a of FIG. 9(*a*), and FIG. 9(*c*) is a sectional view taken along line b—b of FIG. 9(*b*);

DETAILED DESCRIPTION OF THE PREFERRED EMBODIMENTS

Figure 1:
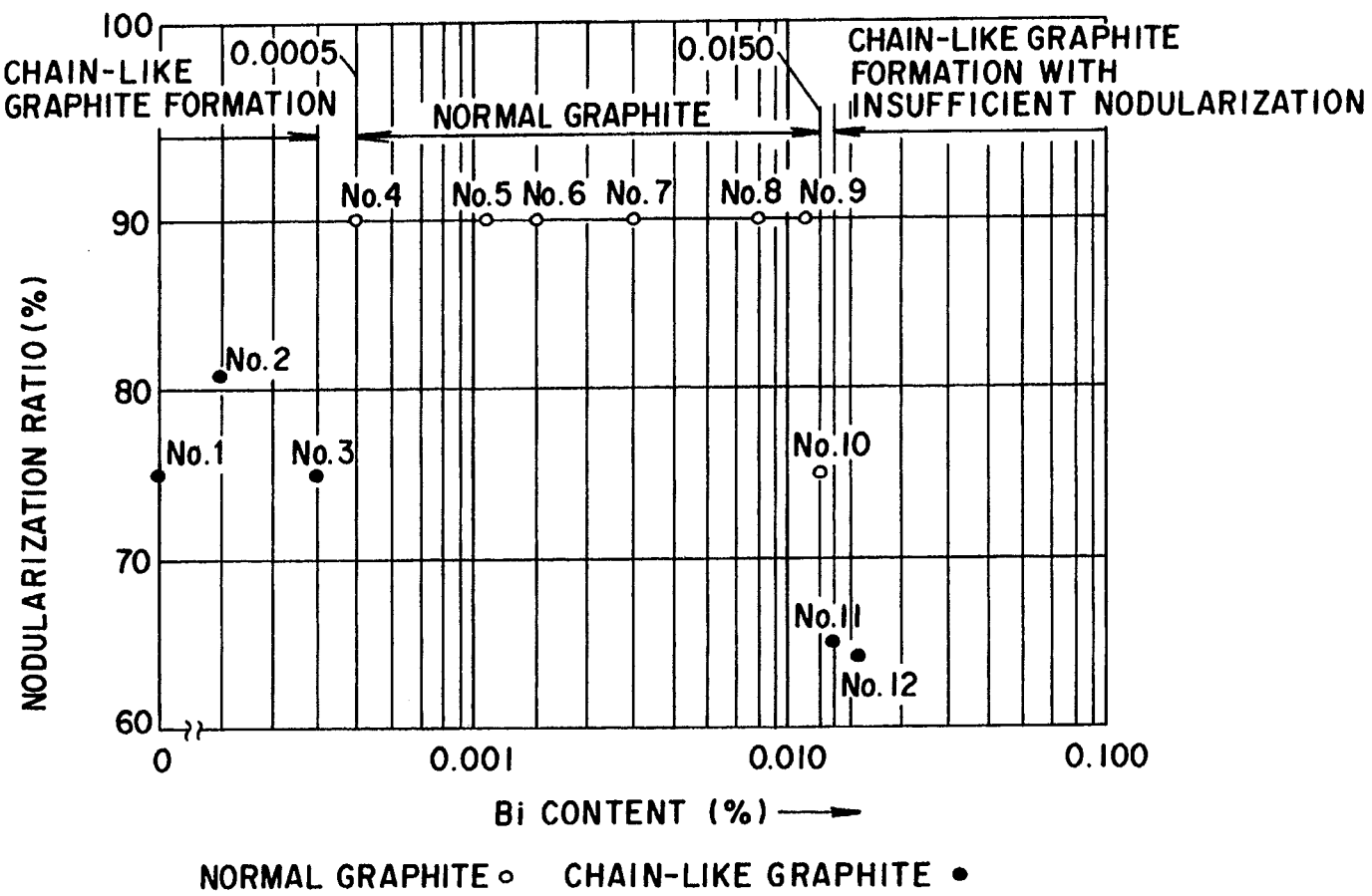
FIG. 1 is a graph showing the relationship between the Bi content and the ratio of graphite nodularization.
Figure 2:
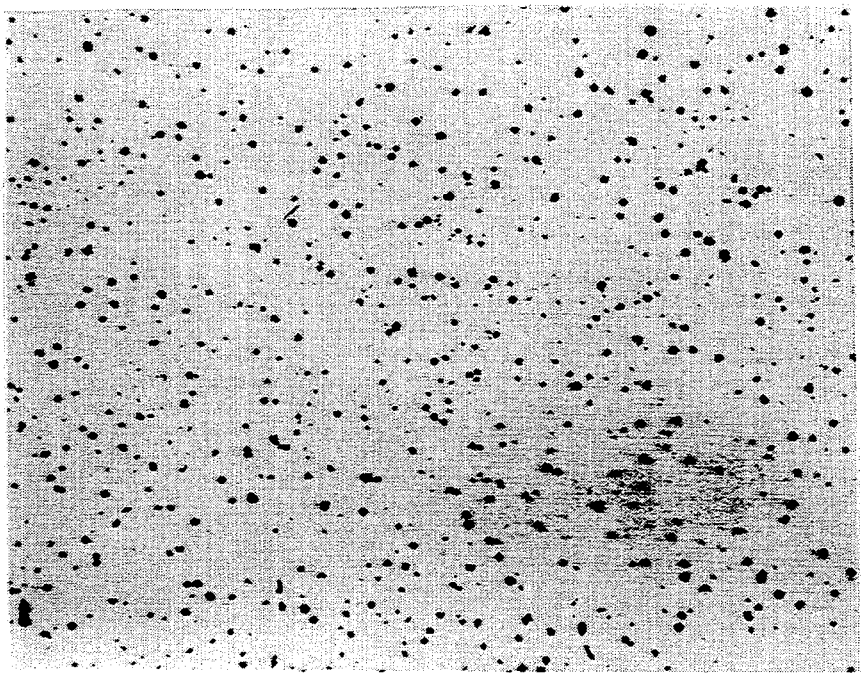
FIG. 2 is a photomicrograph of #6 cast steel of the present invention which is shown in Table 1.
Figure 3:
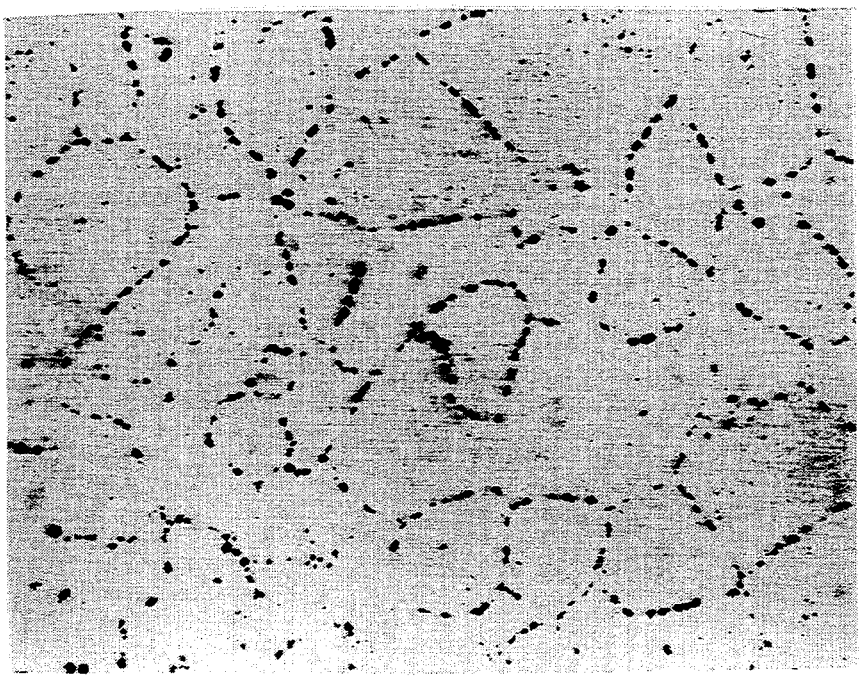
FIG. 3 is a photomicrograph of #1 prior art cast steel which is shown in Table 1.

Table 1 shows the composition of cast steels according to the present invention (#4 through #10), and prior art cast steels (#1 through #3, #11 and #12) with different Bi contents, in relation to the presence of graphite, the nodularization ratio of graphite, and the presence of chain-like formation of graphite crystals. FIG. 1 shows the relationship between the Bi content and the nodularization ratio of graphite in regard to these cast steels. FIG. 2 is a photomicrograph of #6 cast steel according to the present invention, and FIG. 3 is a photomicrograph of #1 prior art cast steel. As can be seen from these photomicrographs and Table 1, when the Bi content is between 0.005% and 0.015%, the graphite nodularization ratio is high (normally, a graphite nodularization ratio of 70% or higher is acceptable), and fine graphite nodules are evenly distributed in the cast steel. It can be seen that the graphite nodularization ratio either sharply drops or chain-like formation of graphite crystals occurs when the Bi content falls out of this range.

TABLE 1

| | composition (wt %) | | | | | | | | | | | nodularization ratio (%) | chain-like graphite formation |
|---|---|---|---|---|---|---|---|---|---|---|---|---|---|
| | C | Si | Mn | P | S | REM | Ca | Bi | Al | Fe | graphite | | |
| present invention | | | | | | | | | | | | | |
| NO. 4 | 1.02 | 3.50 | 0.22 | 0 | 0.015 | 0.118 | 0.011 | 0.00050 | 0.059 | bal. | yes | 90 | none |
| NO. 5 | 1.06 | 3.53 | 0.22 | 0 | 0.017 | 0.106 | 0.009 | 0.0012 | 0.055 | bal. | yes | 90 | none |
| NO. 6 | 1.02 | 3.45 | 0.21 | 0 | 0.011 | 0.115 | 0.004 | 0.002 | 0.032 | bal. | yes | 95 | none |

TABLE 1-continued

| | composition (wt %) | | | | | | | | | | graphite | nodular-ization ratio (%) | chain-like graphite formation |
|---|---|---|---|---|---|---|---|---|---|---|---|---|---|
| | C | Si | Mn | P | S | REM | Ca | Bi | Al | Fe | | | |
| NO. 7 | 0.99 | 3.48 | 0.22 | 0 | 0.013 | 0.098 | 0.010 | 0.004 | 0.051 | bal. | yes | 90 | none |
| NO. 8 | 0.99 | 3.44 | 0.23 | 0 | 0.014 | 0.078 | 0.008 | 0.008 | 0.042 | bal. | yes | 90 | none |
| NO. 9 | 1.01 | 3.51 | 0.24 | 0 | 0.015 | 0.062 | 0.006 | 0.011 | 0.038 | bal. | yes | 90 | none |
| NO. 10 | 0.98 | 3.47 | 0.22 | 0 | 0.014 | 0.058 | 0.007 | 0.015 | 0.040 | bal. | yes | 75 | none |
| prior art | | | | | | | | | | | | | |
| NO. 1 | 1.02 | 3.49 | 0.22 | 0 | 0.015 | 0.108 | 0.007 | 0 | 0.063 | bal. | yes | 75 | yes |
| NO. 2 | 0.96 | 3.51 | 0.22 | 0 | 0.013 | 0.096 | 0.009 | 0.00020 | 0.056 | bal. | yes | 80 | yes |
| NO. 3 | 0.97 | 3.47 | 0.22 | 0 | 0.014 | 0.120 | 0.005 | 0.00040 | 0.043 | bal. | yes | 75 | yes |
| NO. 11 | 0.89 | 3.55 | 0.21 | 0 | 0.013 | 0.046 | 0.006 | 0.017 | 0.037 | bal. | yes | 65 | yes |
| NO. 12 | 0.99 | 3.44 | 0.23 | 0 | 0.013 | 0.052 | 0.006 | 0.022 | 0.043 | bal. | yes | 64 | yes |

Table 2 shows the composition of cast steels according to the present invention (#14 through #17), and prior art cast steels (#13 and #18 through #20) with different C contents, in relation to the presence of graphite, the nodularization ratio of graphite, and the presence of chain-like formation of graphite crystals. As can be seen from Table 2, when the C content is between 0.45% and 1.5%, the graphite nodularization ratio is high, but, when the C content falls out of this range, the graphite nodularization ratio either sharply drops or graphite crystals fail to form.

Table 3 shows the composition of cast steels according to the present invention (#22 through #25), and prior art cast steels (#21 and #26) with different Si contents, in relation to the presence of graphite, the nodularization ratio of graphite, and the presence of chain-like formation of graphite crystals. As can be seen from Table 3, when the Si content is between 1.0% and 5.5%, the graphite nodularization ratio is high, but, when the Si content falls out of this range, the graphite nodularization ratio either sharply drops or graphite crystals fail to form.

Table 4 shows the composition of cast steel according to the present invention (#28), and prior art cast steels (#27, #29 and #30) with different REM contents, in relation to the presence of graphite, the nodularization ratio of graphite, and the presence of chain-like formation of graphite crystals. As can be seen from Table 4, when the REM content is between 0.008% and 0.25%, the graphite nodularization ratio is high, but problems such as chain-like formation of graphite crystals, failure to crystallize graphite and segregation of graphite crystals may occur when the REM content falls out of this range.

TABLE 2

| | composition (wt %) | | | | | | | | | | graphite | nodular-ization ratio (%) | chain-like graphite formation |
|---|---|---|---|---|---|---|---|---|---|---|---|---|---|
| | C | Si | Mn | P | S | REM | Ca | Bi | Al | Fe | | | |
| present invention | | | | | | | | | | | | | |
| NO. 16 | 1.17 | 3.50 | 0.20 | 0 | 0.014 | 0.106 | 0.005 | 0.001 | 0.05 | bal. | yes | 90 | none |
| NO. 15 | 0.53 | 1.97 | 0.19 | 0 | 0.013 | 0.120 | 0.006 | 0.002 | 0.03 | bal. | yes | 90 | none |
| NO. 17 | 1.45 | 1.02 | 0.18 | 0 | 0.014 | 0.092 | 0.008 | 0.003 | 0.05 | bal. | yes | 90 | none |
| NO. 14 | 0.46 | 3.40 | 0.19 | 0 | 0.013 | 0.097 | 0.007 | 0.002 | 0.06 | bal. | yes | 90 | none |
| prior art | | | | | | | | | | | | | |
| NO. 19 | 1.82 | 3.41 | 0.22 | 0 | 0.018 | 0.115 | 0.005 | 0.001 | 0.03 | bal. | yes | 40 | none |
| NO. 13 | 0.40 | 2.03 | 0.23 | 0 | 0.014 | 0.107 | 0.006 | 0.002 | 0.06 | bal. | none | — | none |
| NO. 20 | 2.50 | 3.54 | 0.20 | 0 | 0.011 | 0.095 | 0.005 | 0.002 | 0.05 | bal. | yes | 39 | none |
| NO. 18 | 1.61 | 3.46 | 0.21 | 0 | 0.014 | 0.054 | 0.004 | 0.001 | 0.05 | bal. | yes | 60 | none |

TABLE 3

| | composition (wt %) | | | | | | | | | | graphite | nodular-ization ratio (%) | chain-like graphite formation |
|---|---|---|---|---|---|---|---|---|---|---|---|---|---|
| | C | Si | Mn | P | S | REM | Ca | Bi | Al | Fe | | | |
| present invention | | | | | | | | | | | | | |
| NO. 25 | 0.98 | 5.47 | 0.20 | 0 | 0.015 | 0.115 | 0.005 | 0.003 | 0.05 | bal. | yes | 90 | none |
| NO. 24 | 1.06 | 4.62 | 0.20 | 0 | 0.015 | 0.248 | 0.006 | 0.001 | 0.03 | bal. | yes | 90 | none |
| NO. 22 | 1.01 | 1.09 | 0.19 | 0 | 0.009 | 0.120 | 0.005 | 0.002 | 0.03 | bal. | yes | 90 | none |
| NO. 23 | 0.82 | 3.55 | 0.21 | 0 | 0.013 | 0.101 | 0.005 | 0.002 | 0.06 | bal. | yes | 90 | none |
| prior art | | | | | | | | | | | | | |
| NO. 21 | 1.03 | 0.80 | 0.18 | 0 | 0.011 | 0.098 | 0.005 | 0.002 | 0.06 | bal. | none | — | none |
| NO. 26 | 1.02 | 5.60 | 0.20 | 0 | 0.014 | 0.121 | 0.006 | 0.003 | 0.03 | bal. | yes | 50 | none |

TABLE 4

| | composition (wt %) | | | | | | | | | | graphite | nodular-ization ratio (%) | chain-like graphite formation |
|---|---|---|---|---|---|---|---|---|---|---|---|---|---|
| | C | Si | Mn | P | S | REM | Ca | Bi | Al | Fe | | | |
| present invention | | | | | | | | | | | | | |
| NO. 28 | 1.00 | 3.48 | 0.23 | 0 | 0.013 | 0.11 | 0.003 | 0.002 | 0.05 | bal. | yes | 75 | none |

TABLE 4-continued

| | composition (wt %) | | | | | | | | | | | nodular-ization ratio (%) | chain-like graphite formation |
|---|---|---|---|---|---|---|---|---|---|---|---|---|---|
| | C | Si | Mn | P | S | REM | Ca | Bi | Al | Fe | graphite | | |
| prior art | | | | | | | | | | | | | |
| NO. 30 | 1.56 | 3.51 | 0.22 | 0 | 0.015 | 0.26 | 0.002 | 0.001 | 0.01 | bal. | yes | | yes |
| NO. 27 | 0.98 | 3.21 | 0.21 | 0 | 0.015 | 0.0051 | 0.003 | 0.002 | 0.05 | bal. | none | — | none |
| NO. 29 | 1.02 | 1.92 | 0.22 | 0 | 0.011 | 0.30 | 0.005 | 0.004 | 0.03 | bal. | segregation | | |

Figure 4:
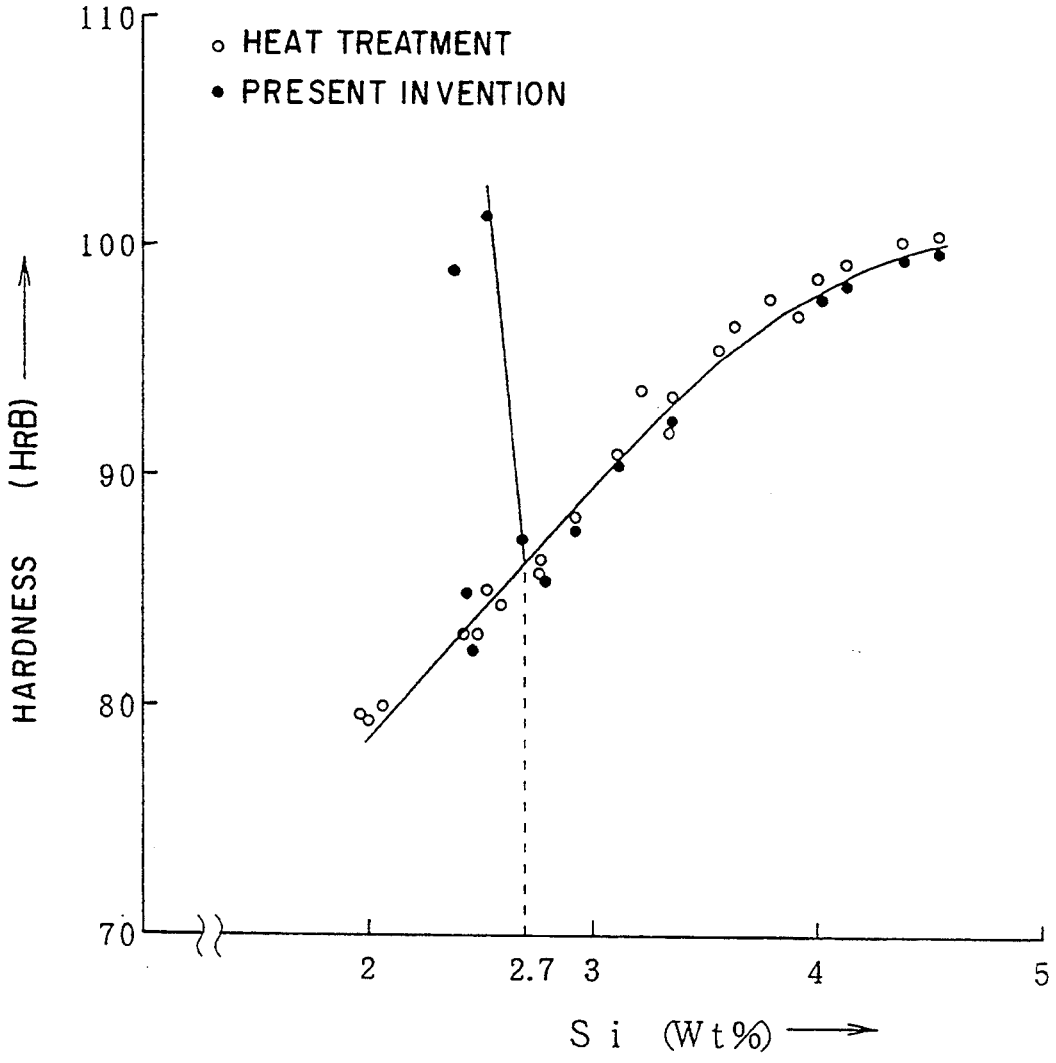
FIG. 4 is a graph showing the relationship between the Si content and hardness in regard to the cast steel of the present invention and the prior art cast steel which is subjected to a ferritization process.
Figure 5:
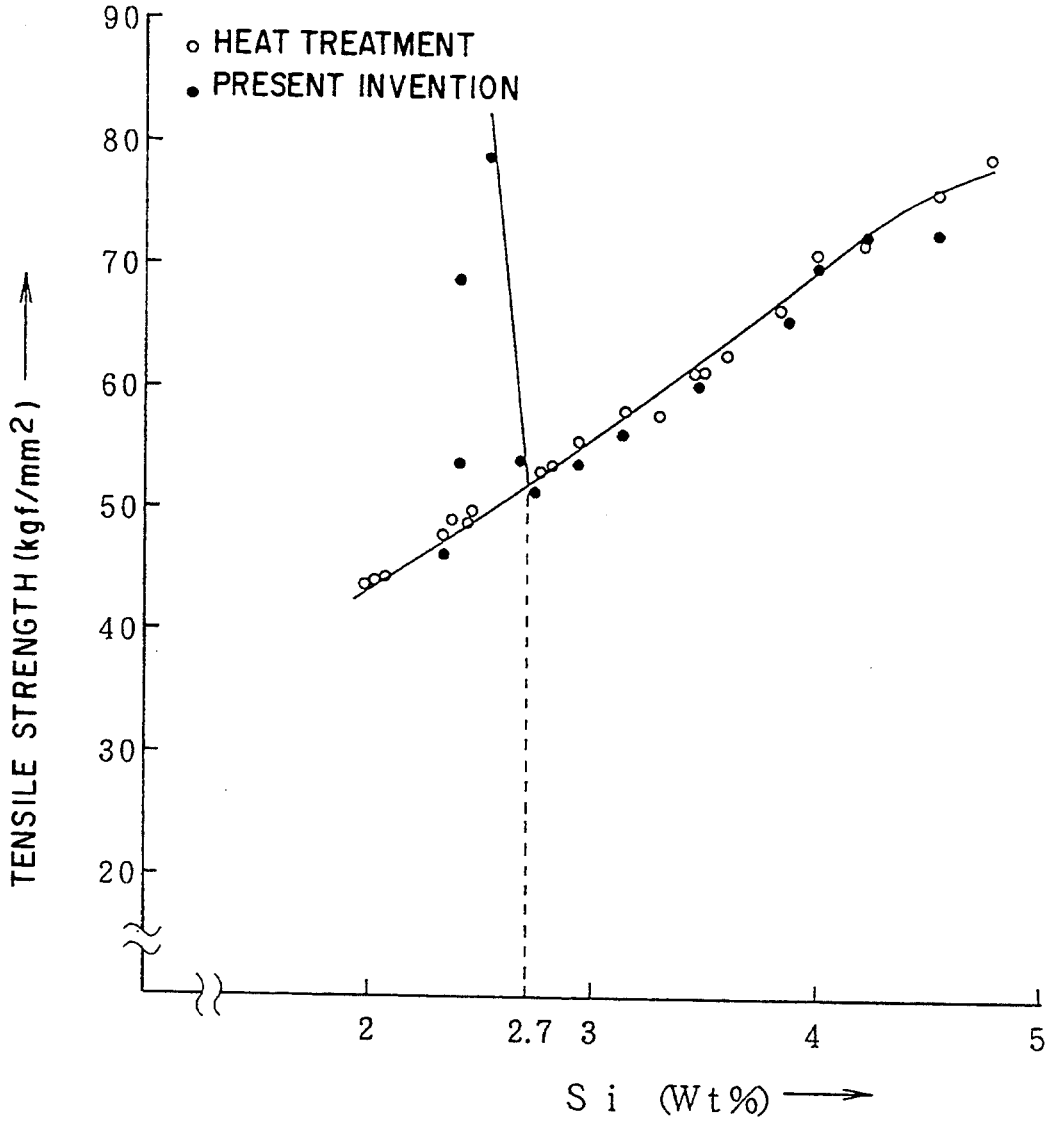
FIG. 5 is a graph showing the relationship between the Si content and tensile strength in regard to the cast steel of the present invention and the prior art cast steel which is subjected to a ferritization process.
Figure 6:
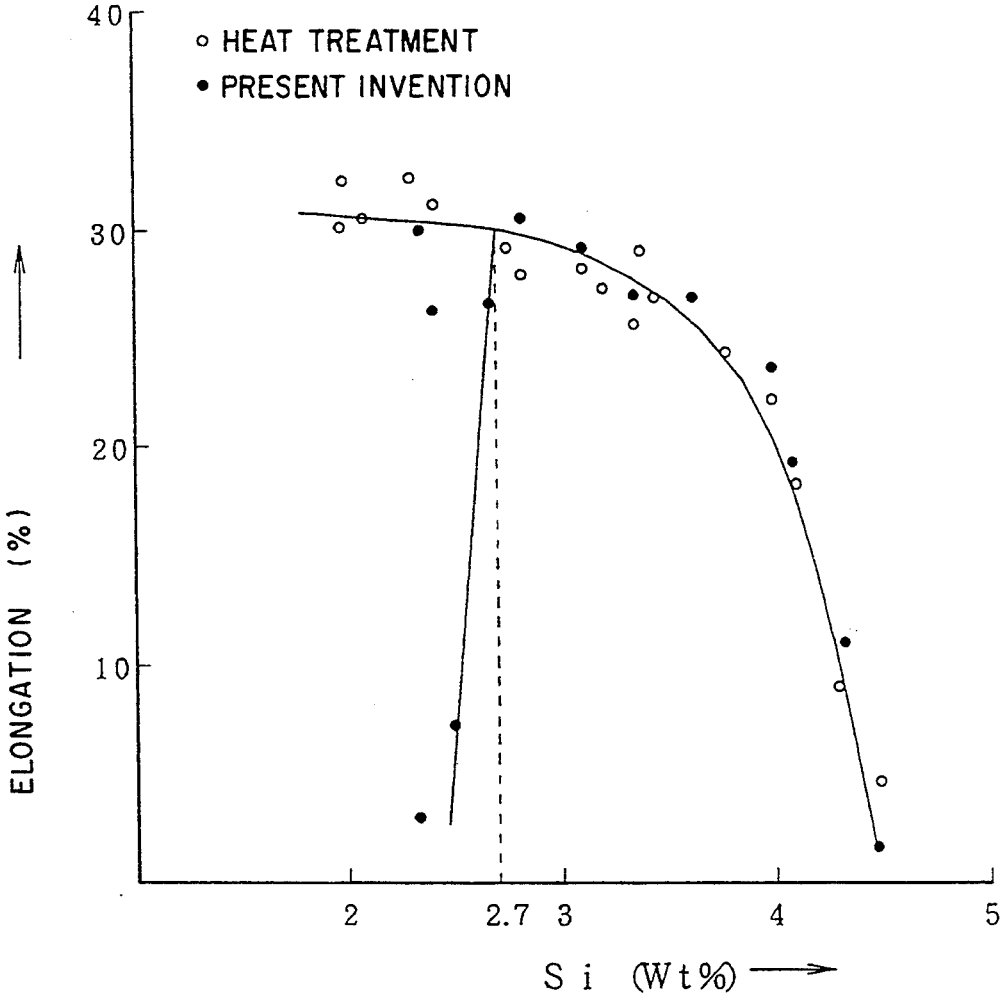
FIG. 6 is a graph showing the relationship between the Si content and elongation in regard to the cast steel of the present invention and the prior art cast steel which is subjected to a ferritization process.

To look for desired hardness, tensile strength and elongation, FIGS. 4, 5 and 6 are given here to show the relationship between these properties and the Si content by varying Si contents while the REM content is fixed at a level higher than 0.05% with regard to cast steel of the present invention and the prior art cast steel which is subjected to a ferritization process at 770° C. for two hours. Since the ferritization ratio is desired to be higher than 95% to achieve desired hardness, tensile strength and elongation, the change in the ferritization ratio of the cast steel of the present invention is shown in the graph of FIG. 7 for different REM and Si contents.

As can be seen from FIGS. 4 through 7, according to the cast steel of the present invention with the Si content higher than 2.7% and the REM content higher than 0.05%, the ferritization ratio is higher than 95% even without any heat treatment, and the achieved hardness, tensile strength and elongation are comparable to those of cast steel which is subjected to heat treatment.

Figure 8:
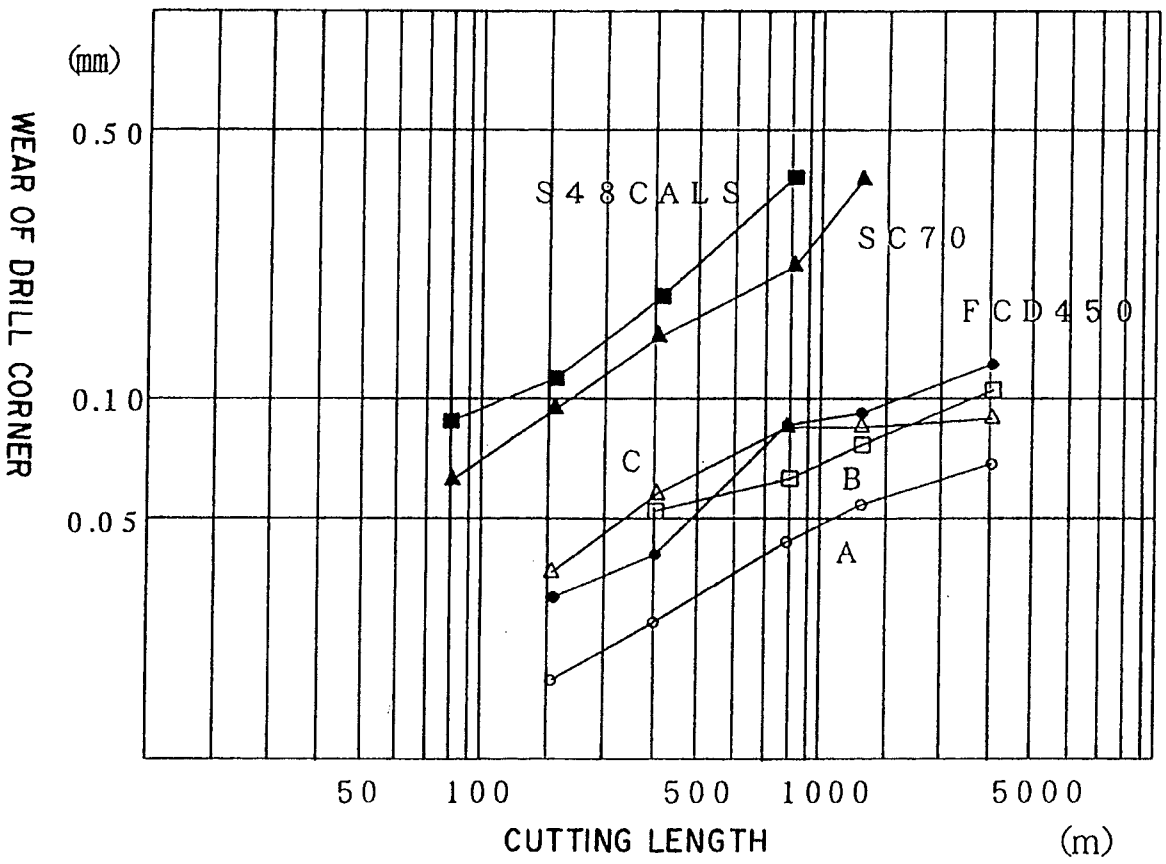
FIG. 8 is a graph showing machining chip lengths and the wear of a corner portion of a drill bit when drilling is performed on the cast steel of the present invention and the prior art cast steel.

FIG. 8 shows the relationship between the cutting length and the wear of a drill bit when drilling is performed on the cast steels of the present invention with the Si content 3.2% (as cast: A), 3.5% (as cast: B) and 3.5% (with heat treatment: C), respectively, and the prior art cast steels including S48CALS (free-machining steel), SC70 (standard cast steel) and FCD450. As can be seen from this graph, the machining property of the cast steels of the present invention are far more superior than those of the conventional cast steels, and is equivalent to or better than that of FCD450.

Figure 7:
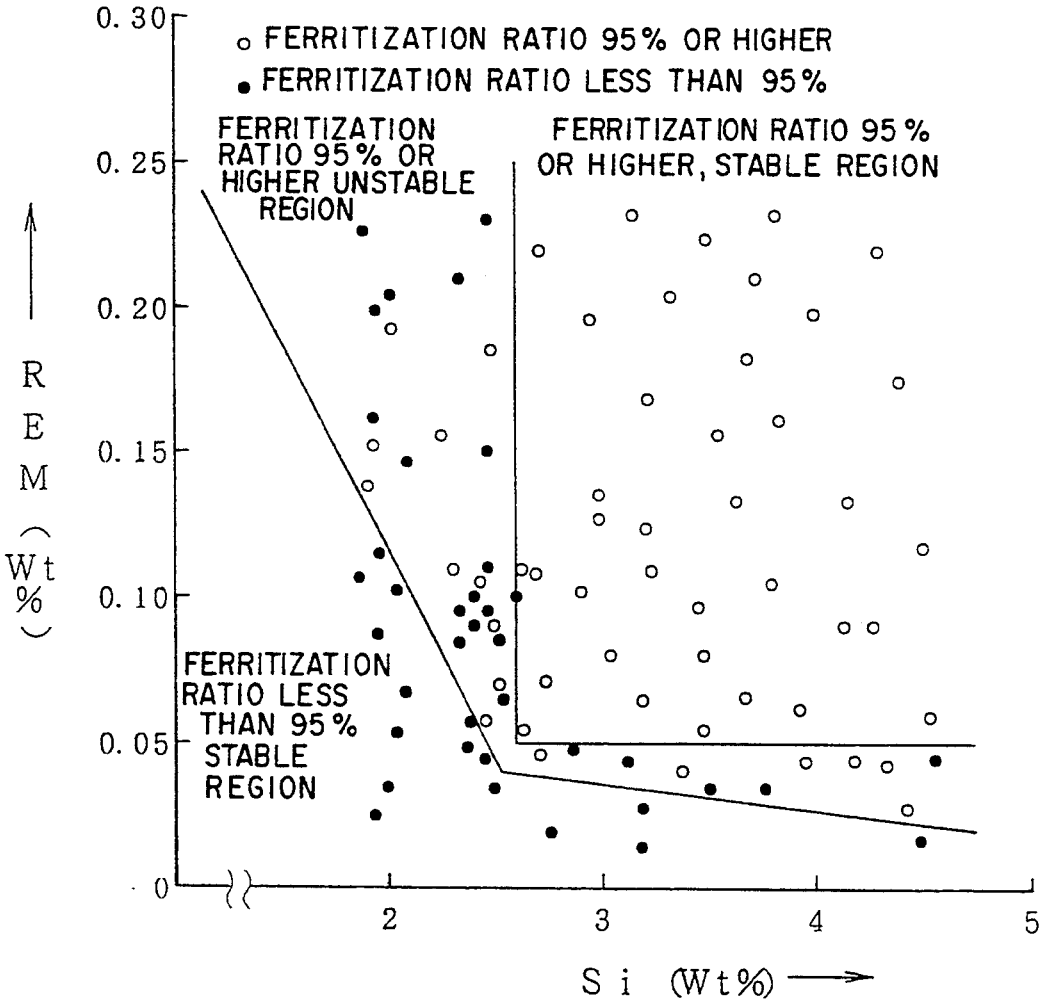
FIG. 7 is a graph showing the ferritization ratio of the cast steel of the present invention in relation to the REM and Si contents.

When the Si content is 2.7% in the cast steel of the present invention, since the ferritization ratio is substantially high as shown in FIG. 7, the cast steel of the present invention, even in its as cast condition, offers a machining property equivalent to those of heat treated conventional cast steels.

Figure 10A:
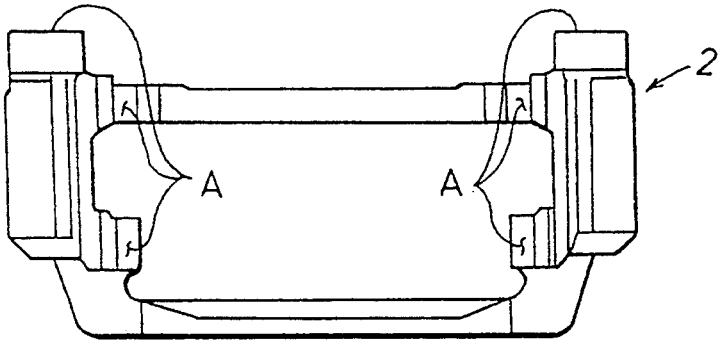
FIG. 10(*a*) is a plan view of a caliper bracket for a disk brake unit to which the cast steel of the present invention is applied, FIG. 10(*b*) is a front view of FIG. 10(*a*), and FIG. 10(*c*) is a sectional view taken along line b—b of FIG. 10(*b*)
Figure 10B:
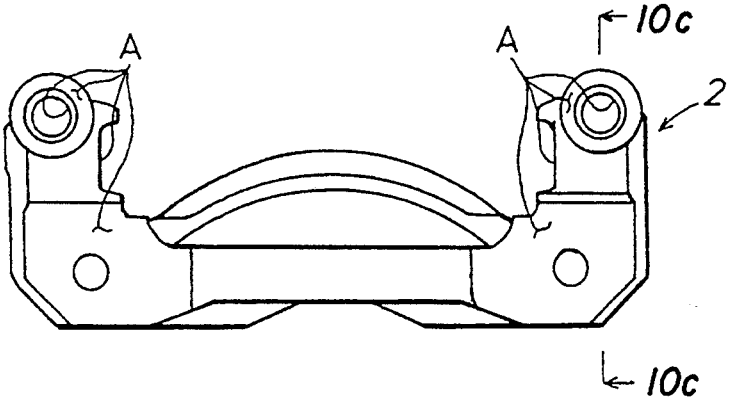
Figure 10C:
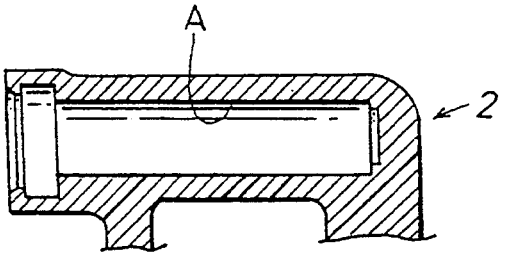

FIGS. 9(*a*), (*b*) and (*c*), and FIGS. 10(*a*), (*b*) and (*c*) show a caliper body 1 and a caliper bracket 2 for an automotive disk brake made of the cast steel of the present invention. The surfaces indicated by letter "A" are the surfaces finished by machining. According to the caliper body 1 and the caliper bracket 2 made from the cast steel of the present invention, owing to the superior machining property comparable to that of FCD450 and the high rigidity, some improvement in the performance of the disk brake was achieved.

Table 5 compares the test results obtained by measuring various mechanical properties (such as tensile strength, 0.02 % offset yield strength, elongation and hardness) of the cast steels of the present invention (#31 and #32) and the prior art cast steels (#33 and #34) having different compositions, and the results of a thermal load test such as crack lengths, numbers of cracks and oxidization losses. The thermal load test consisted of assessing the condition of the cracks after 25 cycles of mode 1 test including the steps of heating up to 850° C., cooling by water for two minutes, and letting water drip off for three minutes, and ten cycles of mode 2 test including the steps of heating up to 1,000° C., cooling by water for two minutes, and letting water drip off for three minutes. The oxidization loss is computed by the following formula:

[(weight after test)/(weight before test)]*100(%)

TABLE 5

| | composition (wt %) | | | | | | | | | |
|---|---|---|---|---|---|---|---|---|---|---|
| | C | Si | Mn | P | S | Ca | REM | B | Al | Fe |
| present invention | | | | | | | | | | |
| NO. 31 | 0.76 | 2.55 | 0.17 | 0.002 | 0.013 | 0.005 | 0.103 | 0.00 | 0.037 | |
| NO. 32 | 1.01 | 3.69 | 0.19 | 0.002 | 0.011 | 0.008 | 0.114 | 0.00 | 0.035 | |
| prior art | | | | | | | | | | |
| NO. 33 | 3.53 | 3.46 | 0.33 | 0.002 | 0.009 | — | — | — | — | |
| NO. 34 | 3.49 | 3.70 | 0.25 | 0.003 | 0.008 | — | — | — | — | |

| | mechanical properties | | | | thermal load test | | |
|---|---|---|---|---|---|---|---|
| | tensile strength | offset* yield strength | elongation | hardness | crack length | number of cracks | oxidization loss |
| present invention | | | | | | | |
| NO. 31 | 50.0 kg/m$^2$ | 35.0 kg/m$^2$ | 26% | HR 83.2 | 105 mm | 11 | 6.67% |
| NO. 32 | 65.0 | 50.0 | 20 | 96.2 | 86 | 9 | 3.41 |
| prior art | | | | | | | |
| NO. 33 | 50.5 | 39.0 | 12 | 88.0 | 905 | 65 | 4.25 |
| NO. 34 | 51.0 | 39.5 | 10 | 90.0 | 4345 | 353 | 3.15 |

Figure 11:
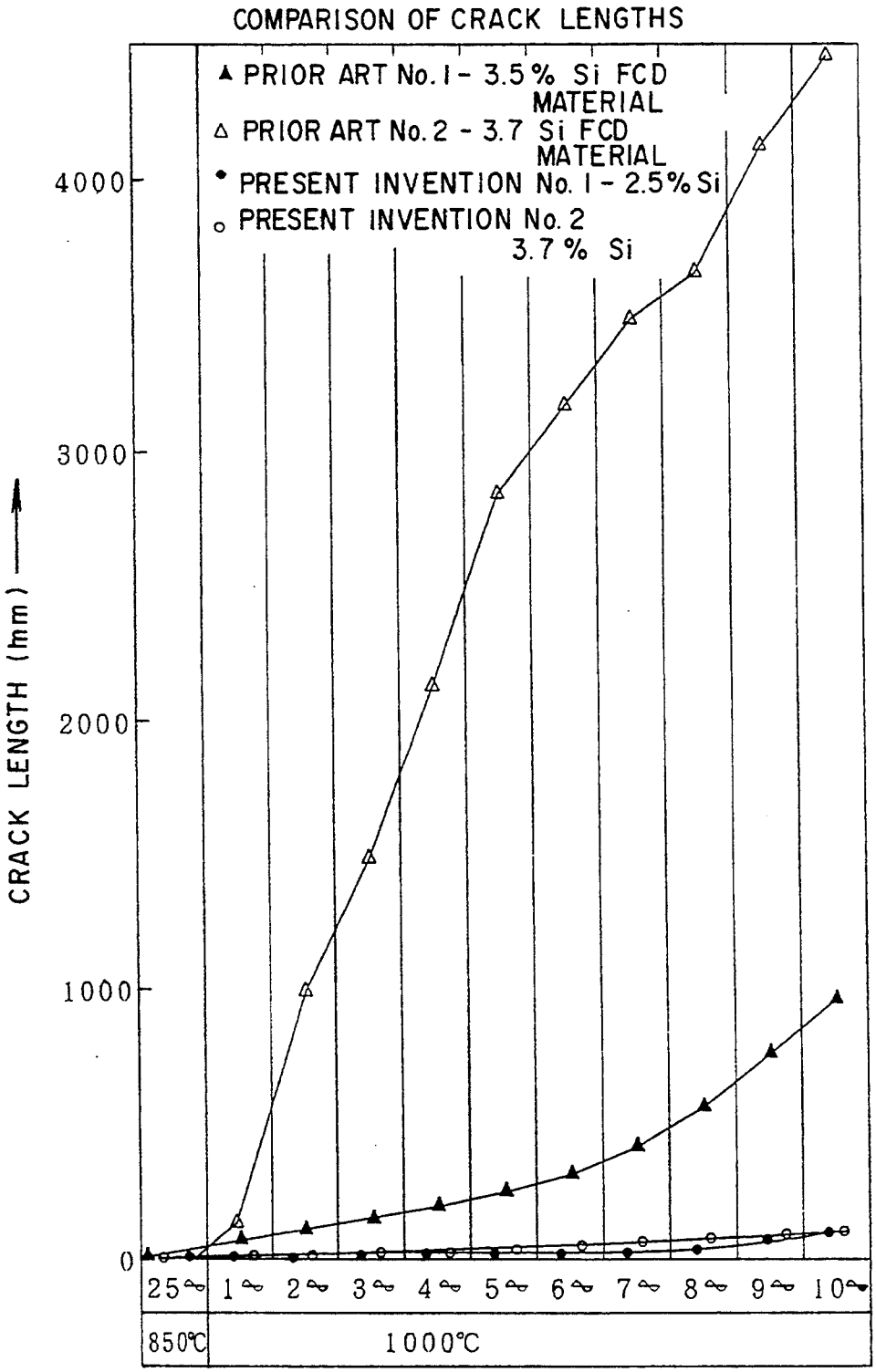
FIG. 11 is a graph showing the time history change of the crack lengths when the thermal load test is conducted on the cast steel of the present invention and the prior art cast steel.
Figure 12:
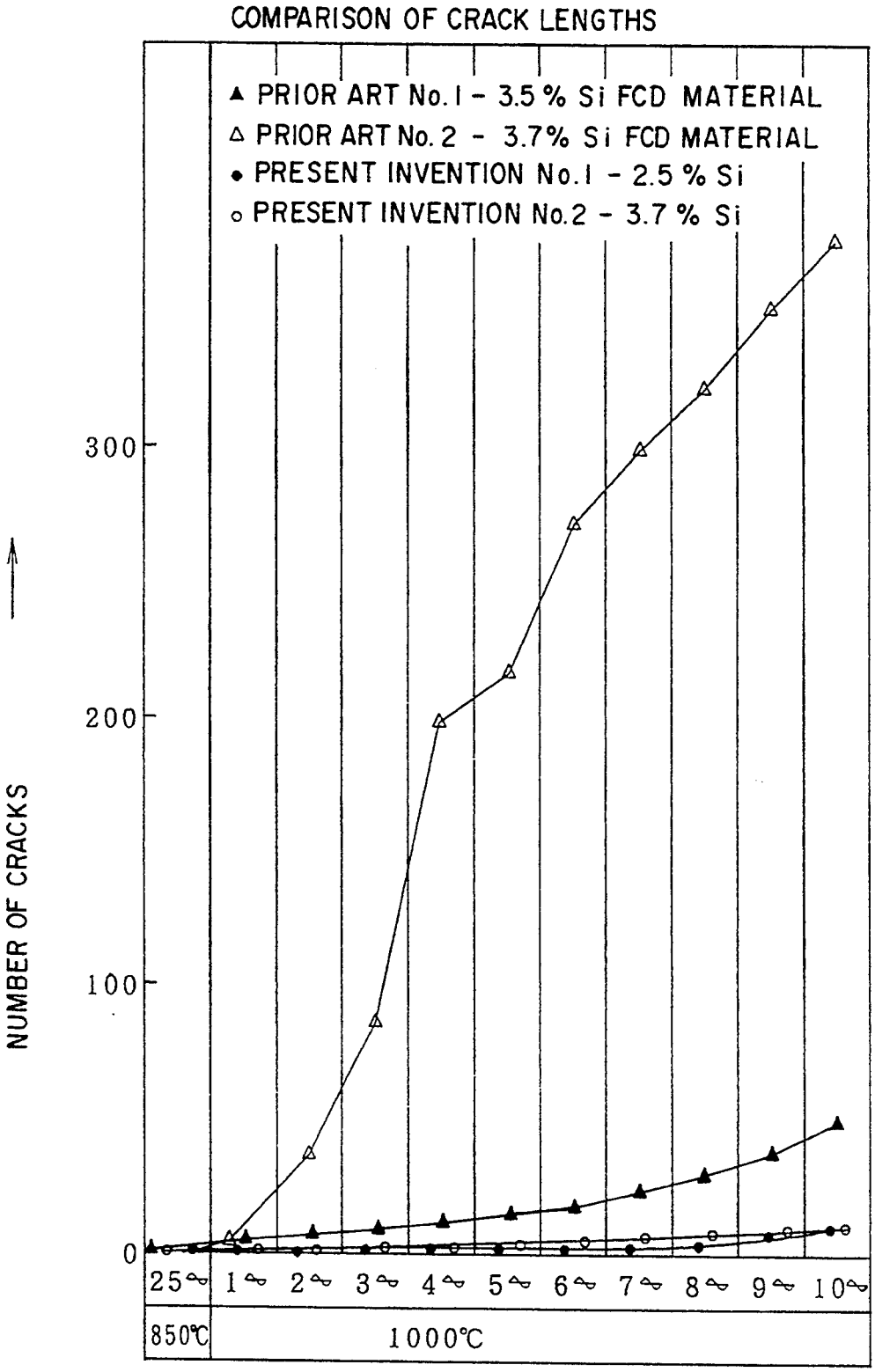
FIG. 12 is a graph showing the time history change of the number of cracks when the thermal load test is conducted on the cast steel of the present invention and the prior art cast steel.

Tables 6 and 7, and FIGS. 11 and 12 show the time history changes of the crack length and the number of cracks for each specimen of cast steel (#31 to #34) when applying ten cycles of mode 2 test following the application of 25 cycles of mode 1 test. Upon completion of ten cycles of mode 2 test, large continuous cracks were observed to develop in the case of the prior art cast steels, but only minute cracks developed in the case of the cast steels of the present invention.

As can be seen from these tables and graphs, since the cast steel of the present invention contains relatively small amounts of carbon, and does not involve coarsening of graphite crystals, there is a less possibility of developing inner stress due to the conversion of carbon into the form of graphite, and the generation of cracks can be controlled. Therefore, according to the cast steel of the present invention, toughness against cracks, and the permissible operation temperature of the cast steel material can be increased. For instance, when an exhaust manifold is made from the cast steel of the present invention, the permissible temperature of the exhaust manifold can be substantially increased, and it allows more freedom in the design of a high performance internal combustion engine.

Figure 13:
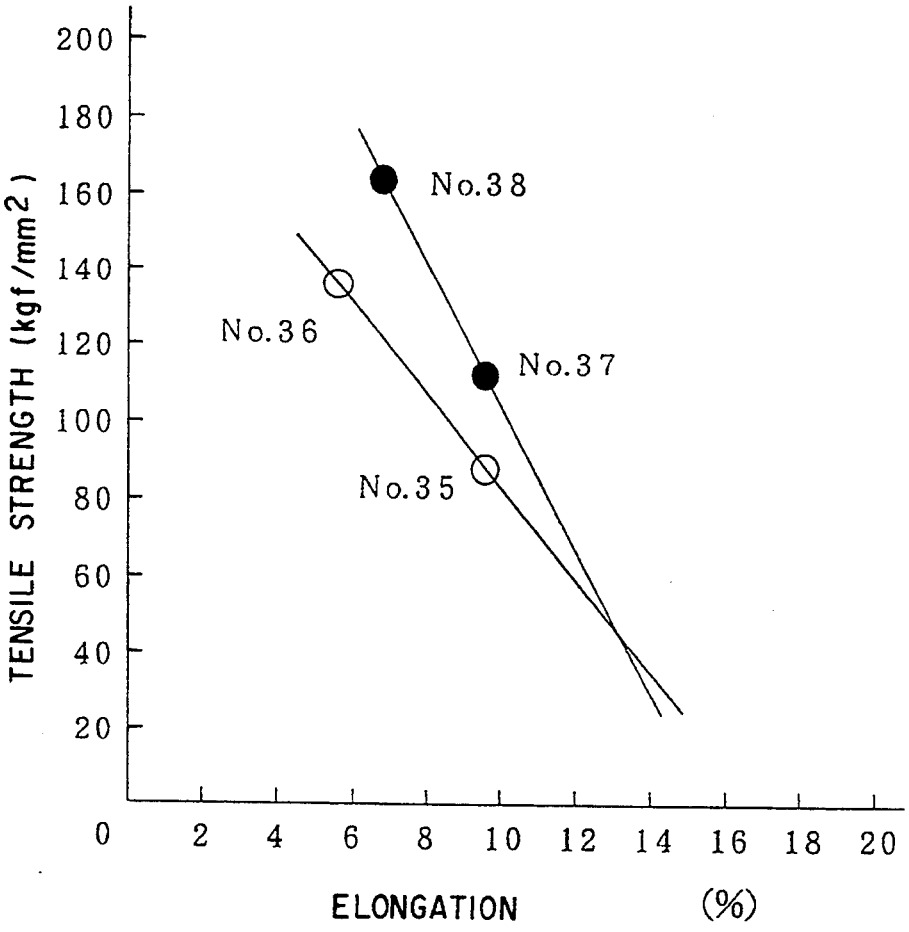
FIG. 13 is a graph showing tensile strength and elongation when Mo and/or Cu is added to the cast steel of the present invention, and a heat treatment is carried out.

Further, by adding Mo and/or Cu to the cast steel of the present invention at levels lower than 1.0% as indicated in Table 8, an improvement in tensile strength can be achieved as shown in Table 8 and FIG. 13. By performing a heat treatment to the cast steel of the present invention as shown in Table 8, an improvement in tensile strength can be achieved and a favorable elongation can be maintained as shown in Table 8 and FIG. 13.

TABLE 6

| | | overall crack length for each test cycle (mm) | | | | | | | | | | |
|---|---|---|---|---|---|---|---|---|---|---|---|---|
| | | 850° C. | 1000° C. | | | | | | | | | |
| | | 25∞ | 1∞ | 2∞ | 3∞ | 4∞ | 5∞ | 6∞ | 7∞ | 8∞ | 9∞ | 10∞ |
| present invention | | | | | | | | | | | | |
| NO. 31 | 2.5% Si | 5 | 5 | 5 | 5 | 5 | 5 | 5 | 15 | 20 | 45 | 105 |
| NO. 32 | 3.7% Si | 19 | 19 | 19 | 19 | 34 | 34 | 51 | 57 | 58 | 86 | 86 |
| prior art | | | | | | | | | | | | |
| NO. 33 | 3.5% Si | 15 | 85 | 135 | 155 | 190 | 255 | 330 | 440* | 560 | 655 | 905 |
| NO. 34 | 3.7% Si | 0 | 200 | 1035* | 1452 | 2078 | 2767 | 3087 | 3499 | 3611 | 4088 | 4345 |

*generation of continuous cracks

TABLE 7

| | | overall crack length for each test cycle | | | | | | | | | | |
|---|---|---|---|---|---|---|---|---|---|---|---|---|
| | | 850° C. | 1000° C. | | | | | | | | | |
| | | 25∞ | 1∞ | 2∞ | 3∞ | 4∞ | 5∞ | 6∞ | 7∞ | 8∞ | 9∞ | 10∞ |
| present invention | | | | | | | | | | | | |
| NO. 31 | 2.5% Si | 1 | 1 | 1 | 1 | 1 | 1 | 1 | 2 | 3 | 6 | 11 |
| NO. 32 | 3.7% Si | 1 | 1 | 1 | 1 | 3 | 3 | 6 | 8 | 8 | 9 | 9 |
| prior art | | | | | | | | | | | | |
| NO. 33 | 3.5% Si | 1 | 4 | 5 | 7 | 9 | 15 | 19 | 24* | 32 | 42 | 65 |
| NO. 34 | 3.7% Si | 0 | 4 | 31* | 83 | 144 | 197 | 218 | 264 | 293 | 329 | 353 |

*generation of continuous cracks

TABLE 8

| basic material composition | | | | | heat treatment | | hardness $H_RC$ (range) | tensile strength (range) kgf/mm$^2$ | elongation (range) % |
|---|---|---|---|---|---|---|---|---|---|
| C | Si | Mn | S | NO. 35 | quenching | water | 25.1 | 83.6 | 9.6 |
| 0.99 | 2.09 | 0.23 | 0.010 | | 850° C. × 2 Hr→ | cooling (18° C. | (24.4~26.1) | (81.9~85.2) | (8.8~10.8) |
| REM | Ca | Bi | | | 600° C. × 1 Hr→ | air | | | |
| 0.105 | 0.006 | 0.002 | | | annealing | cooling | | | |
| | Al | | | NO. 36 | quenching | water | 44.6 | 141.4 | 2.9 |
| | 0.057 | | | | 900° C. × 2 Hr→ | cooling (18° C.) | (43.2~45.4) | (136.6~145.7) | (2.5~3.5) |
| | | | | | 500° C. × 1 Hr→ | air | | | |
| | | | | | annealing | cooling | | | |
| C | Si | Mn | S | NO. 37 | quenching | water | 34.6 | 111.3 | 9.1 |
| 0.95 | 2.07 | 0.26 | 0.013 | | 850° C. × 2 Hr→ | cooling (18° C.) | (34.1~35.0) | (108.0~115.0) | (8.3~10.0) |
| Cu | Mo | REM | | | 600° C. × 1 Hr→ | air | | | |
| 0.18 | 0.22 | 0.097 | | | annealing | cooling | | | |
| Ca | Bi | Al | | NO. 38 | quenching | water | 48.0 | 164.1 | 4.6 |
| 0.004 | 0.003 | 0.062 | | | 900° C. × 2 Hr→ | cooling (18° C.) | (47.8~48.2) | (161.6~167.4) | (4.0~5.0) |
| | | | | | 500° C. × 1 Hr→ | air | | | |
| | | | | | annealing | cooling | | | |

As described above, according to the graphitic cast steel of the present invention, since a large number of fine graphite nodules can be crystallized in the cast steel, and the occurrence of chain-like formation of graphite crystals can be avoided by limiting the Bi content in the cast steel to the range between 0.0005% and 0.0150%, the cast steel can be made to have favorable machining and mechanical property even in its as cast condition.

Although the present invention has been described in terms of specific embodiments thereof, it is possible to modify and alter details thereof without departing from the spirit of the present invention.

What we claim is:

1. Graphitic cast steel, consisting essentially of 0.45 to 1.5 wt % carbon (C), 2.7 to 5.5 wt % silicon (Si), 0.05 to 0.25 wt % rare earth elements (REM), 0.0005 to 0.0150 wt. % bismuth (Bi), 0.005 to 0.080 wt % aluminum (Al), up to 0.020 wt % calcium (Ca), and balance iron (Fe) and inevitable impurities.

2. Graphitic cast steel, consisting of 0.45 to 1.5 wt. % carbon (C), 1.0 to 5.5 wt. % silicon (Si), 0.008 to 0.25 wt. % rare earth elements (REM), 0.0005 to 0.0150 wt. % bismuth (Bi), 0.005 to 0.080 wt. % aluminum (Al), up to 0.020 wt. % calcium (Ca), and balance iron (Fe) and inevitable impurities.

3. Graphitic cast steel according to claim 2, wherein the calcium content is 0.002 to 0.020 wt % calcium (Ca).

4. Graphitic cast steel according to claim 2, wherein said inevitable impurities include no more than 1.0 wt % manganese (Mn), no more than 0.05 wt % sulphur (S), and no more than 0.15 wt % phosphorus (P).

5. Graphitic cast steel according to claim 2, wherein said inevitable impurities include no more than 1.0 wt % molybdenum (Mo).

6. Graphitic cast steel according to claim 2, wherein said inevitable impurities include no more than 1.0 wt % copper (Cu).

7. Graphitic cast steel according to claim 2, wherein said cast steel is subjected to a heat treatment.

* * * * *